US009938096B2

(12) United States Patent
Hashimoto et al.

(10) Patent No.: US 9,938,096 B2
(45) Date of Patent: Apr. 10, 2018

(54) SHEET SUPPLY APPARATUS

(71) Applicant: Brother Kogyo Kabushiki Kaisha, Nagoya (JP)

(72) Inventors: Yohei Hashimoto, Nagakute (JP); Yasuhiro Suzuki, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/466,020

(22) Filed: Mar. 22, 2017

(65) Prior Publication Data

US 2017/0275110 A1 Sep. 28, 2017

(30) Foreign Application Priority Data

Mar. 28, 2016 (JP) ..... 2016-064152

(51) Int. Cl.
*B65H 3/06* (2006.01)
*B65H 3/44* (2006.01)
*G03G 15/00* (2006.01)

(52) U.S. Cl.
CPC ..... *B65H 3/0669* (2013.01); *G03G 15/6529* (2013.01); *B65H 2403/421* (2013.01); *B65H 2403/481* (2013.01); *B65H 2403/51* (2013.01); *B65H 2403/722* (2013.01); *B65H 2801/12* (2013.01)

(58) Field of Classification Search
CPC .. B65H 3/0669; B65H 3/44; B65H 2403/722; B65H 2403/481; B65H 2403/422; B65H 2403/421
See application file for complete search history.

(56) References Cited

U.S. PATENT DOCUMENTS

| | | | | |
|---|---|---|---|---|
| 9,718,632 | B2 * | 8/2017 | Saeki | B65H 3/0669 |
| 2009/0008868 | A1 | 1/2009 | Kuroda | |
| 2014/0294476 | A1 | 10/2014 | Hashimoto et al. | |
| 2017/0152116 | A1 * | 6/2017 | Hashimoto | B65H 3/0669 |
| 2017/0267473 | A1 * | 9/2017 | Watanabe | B65H 5/36 |

FOREIGN PATENT DOCUMENTS

| | | | |
|---|---|---|---|
| JP | H04-169432 | A | 6/1992 |
| JP | 11268838 | A * | 10/1999 |
| JP | 2003-194099 | A | 7/2003 |
| JP | 2009-012925 | A | 1/2009 |
| JP | 2014-199368 | A | 10/2014 |

* cited by examiner

*Primary Examiner* — Luis A Gonzalez
(74) *Attorney, Agent, or Firm* — Burr & Brown, PLLC

(57) ABSTRACT

A sheet supply apparatus detachably attached to an image forming apparatus is configured to receive a drive force from the image apparatus to supply sheet to the image forming apparatus. The sheet supply apparatus includes a sheet supply tray, a sheet supply roller, a first transmission mechanism configured to transmit a drive force from the image forming apparatus to the sheet supply roller, a second transmission mechanism including an output member and configured to transmit a drive force supplied from the image forming apparatus to the output member, a clutch mechanism configured to intermittently transmit a drive force from the image forming apparatus to the second transmission mechanism, a latch member pivotable between a restriction position and an allowance position, a change cam, a sector gear, a rotational force applying member, an engaging member, a first engagement portion, a second engagement portion, and an electromagnetic solenoid.

7 Claims, 14 Drawing Sheets

STATE A

STATE B

STATE A

STATE B

STATE C

STATE D

SHEET SUPPLY APPARATUS

CROSS-REFERENCE TO RELATED APPLICATION

This application claims priority from Japanese Patent Application No. 2016-064152 filed on Mar. 28, 2016, the content of which is incorporated herein by reference in its entirety.

FIELD OF DISCLOSURE

Aspects disclosed herein relate to a sheet supply apparatus configured to supply a sheet.

BACKGROUND

A known sheet supply apparatus is detachably attached to an image forming apparatus configured to form an image on a sheet. The sheet supply apparatus is configured to obtain a drive force from the image forming apparatus to supply a sheet to the image forming apparatus.

The sheet supply apparatus includes a first transmission mechanism and a second transmission mechanism. The first transmission mechanism is configured to transmit the drive force from the image forming apparatus to a sheet supply roller. The second transmission mechanism is configured to transmit the drive force from the image forming apparatus to another sheet supply apparatus.

SUMMARY

The second transmission mechanism includes an output gear for outputting the drive force, and is configured to consistently transmit the drive force from the image forming apparatus to the output gear. In other words, the output gear rotates while the motor of the image forming apparatus is in operation, and does not stop rotating unless the motor stops.

Even when another sheet supply apparatus is not used, the second transmission mechanism operates in response to the operation of the motor, which generates unwanted noise.

Illustrative aspects of the disclosure provide a sheet supply apparatus to reduce generation of unwanted noise.

According to an aspect of the disclosure, a sheet supply apparatus is detachably attached to an image forming apparatus configured to form an image on a sheet. The sheet supply apparatus is configured to receive a drive force from the image forming apparatus to supply a sheet to the image forming apparatus. The sheet supply apparatus includes a sheet supply tray, a sheet supply roller, a first transmission mechanism, a second transmission mechanism, a clutch mechanism, a latch member, a change cam, a sector gear, a rotational force applying member, an engaging member, a first engagement portion, a second engagement portion, and an electromagnetic solenoid. The sheet supply tray is configured to support a sheet. The sheet supply roller is configured to supply the sheet supported on the sheet supply tray toward the image forming apparatus. The first transmission mechanism is configured to transmit a drive force from the image forming apparatus to the sheet supply roller. The second transmission mechanism includes an output member and is configured to transmit a drive force supplied from the image forming apparatus to the output member. The clutch mechanism is configured to intermittently transmit a drive force from the image forming apparatus to the second transmission mechanism, and includes a sun gear, a planetary gear, and an internal gear. The latch member is pivotable between a restriction position where the latch member restricts the planetary gear from revolving around the sun gear and an allowance position where the latch member allows the planetary gear to revolve around the sun gear. The latch member includes a sliding-contact portion. The change cam includes a contact surface on which the sliding-contact portion of the latch member slides. The change cam is configured to rotate in one direction to change between a first position where the latch member is in the allowance position and a second position where the latch member is in the restriction position. The sector gear has a tooth portion and a toothless portion. The sector gear is configured to rotate together with the change cam. The rotational force applying member is configured to apply a rotational force to the sector gear such that the sector gear rotates in the one direction. The engaging member is configured to engage one of the sector gear and the change cam and move between a disengagement position where the sector gear rotates and an engagement position where the sector gear is restricted from rotating. The first engagement portion is disposed at the one of the sector gear and the change cam and configured to, when the change cam is located at the first position, engage the engaging member to restrict the sector gear from rotating. The second engagement portion is disposed at the one of the sector gear and the change cam and spaced apart from the first engagement portion in a rotation direction of the sector gear and the change cam. The second engagement portion is configured to, when the change cam is located at the second position, engage the engaging member to restrict the sector gear from rotating. The electromagnetic solenoid is coupled to the engaging member. The electromagnetic solenoid is configured to, when energized, move the engaging member to the disengagement position, and to, when de-energized, move the engaging member to the engagement position.

The above structure allows the clutch mechanism to, every time the electromagnetic solenoid is energized, switch between a transmission state where a drive force is transmitted and an interruption sate where transmission of a drive force is interrupted.

In other words, while the electromagnetic solenoid is in the de-energized state after it is energized, the clutch mechanism remains in the interruption state until the electromagnetic solenoid is energized next time. Thus, this structure obviates the need to continue to supply power to the electromagnetic solenoid and thus maintains the electromagnetic solenoid in the interruption state, which leads to reduction in power consumption and noise at the second transmission mechanism.

BRIEF DESCRIPTION OF THE DRAWINGS

Reference is made to the following description taken in connection with the accompanying drawings, like reference numerals being used for like corresponding parts in the various drawings.

DETAILED DESCRIPTION

Figure 1:
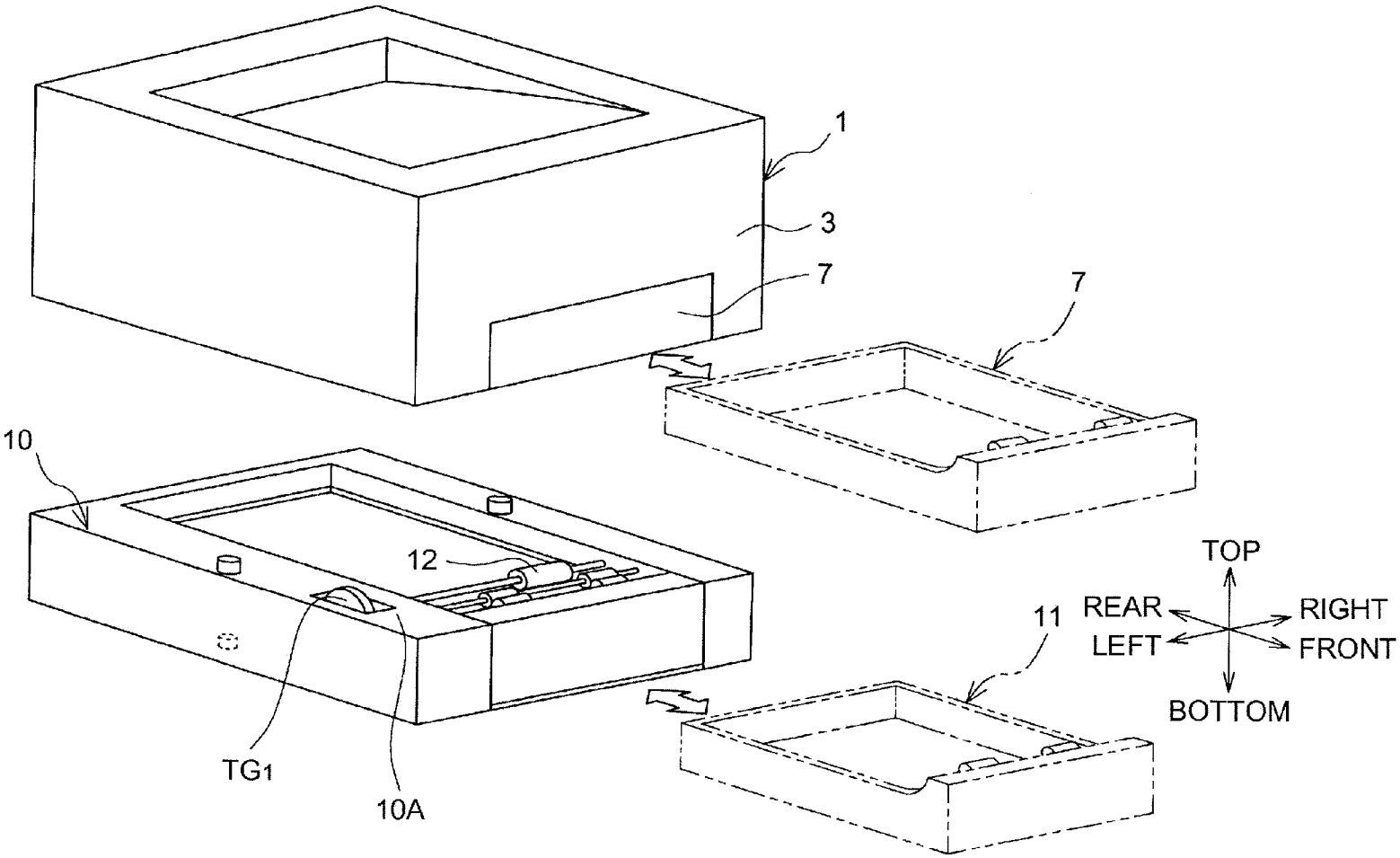
FIG. 1 is a perspective view of an image forming system including an image forming apparatus and a sheet supply apparatus according to a first illustrative embodiment of the disclosure.

Illustrative embodiments described below are merely examples. Various changes, arrangements and modifications may be applied therein without departing from the spirit and scope of the disclosure.

Hereinafter, the illustrative embodiments of the disclosure will be described with reference to the accompanying drawings. Direction arrows indicated in the drawings may help easier understanding of relative relationship between the drawings. Therefore, the directions are not limited to the specific directions indicated in the drawings.

For portions or components, which will be described with numerals, at least one is provided unless "plural" or "two or more" is specifically stated otherwise.

A first illustrative embodiment will be described.

The embodiment of the disclosure is applied to an image forming system including an electrophotographic image forming apparatus 1 and a sheet supply apparatus 10, which are illustrated in FIG. 1. The sheet supply apparatus 10 is optional and can be retrofitted to the image forming apparatus 1. The sheet supply apparatus 10 is detachable from the image forming apparatus 1.

A general outline of the image forming system will be described.

An image forming unit 5 (FIG. 2) is accommodated in the image forming apparatus 1. The image forming unit 5 is of an electrophographic type and configured to form an image on a sheet by transferring a developer image on the sheet. The image forming apparatus 1 includes a sheet supply tray 7, which is detachably attached to a main body of the image forming apparatus 1.

Figure 2:
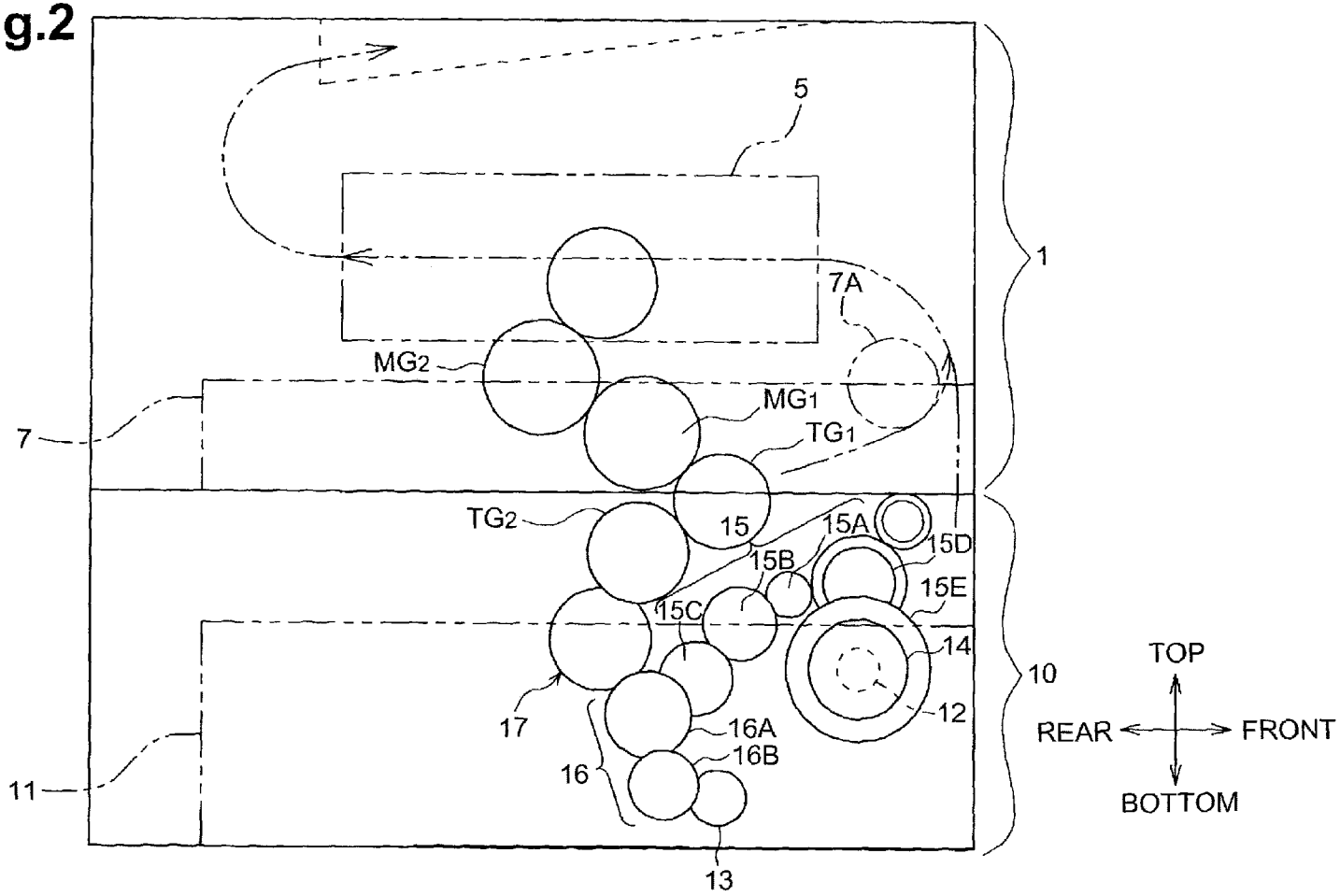
FIG. 2 schematically illustrates a first transmission mechanism and a second transmission mechanism in the image forming system.

The sheet supply tray 7 is configured to support one or more sheets thereon. A sheet supply roller 7A illustrated in FIG. 2 is configured to supply a sheet from the sheet supply tray 7 to the image forming unit 5. A motor M (FIG. 14) is disposed in the image forming apparatus 1.

The motor M generates a drive force to be supplied to the sheet supply roller 7A and other components. An output gear MG1 for outputting a drive force to the sheet supply apparatus 10 is disposed in a lower portion of the image forming apparatus 1. The output gear MG1 receives a drive force generated at the motor M via plural gears including a gear MG2.

The output gear MG1 rotates in response to the rotation of the motor M. In other words, when the motor M rotates, the output gear MG1 also rotates. When the motor M stops, the output gear MG1 also stops.

The sheet supply apparatus 10 will be described.

The sheet supply apparatus 10 is configured to receive a drive force from the image forming apparatus 1 via gears including the output gear MG1 and supply a sheet to the image forming apparatus 1. The sheet supply apparatus 10 includes, in a main body thereof, a sheet supply tray 11. The sheet supply tray 11 is configured to support one or more sheets thereon.

The main body of the sheet supply apparatus 10 refers to portions such as frames and a casing, which are, during normal usage, not disassembled or dismounted by the user. As illustrated in FIG. 1, the sheet supply tray 11 is detachable from the main body of the sheet supply apparatus 10.

As illustrated in FIG. 2, the main body of the sheet supply apparatus 10 includes a sheet supply roller 12, a first transmission mechanism 15, and a second transmission mechanism 16. The sheet supply roller 12 is configured to supply a sheet toward the image forming apparatus 1 by rotating in contact with the sheet supported on the sheet supply tray 11.

The first transmission mechanism 15 is configured to transmit a drive force supplied from the image forming apparatus 1 via the output gear MG1 to the sheet supply roller 12. The first transmission mechanism 15 is a gear train having plural gears 15A-15E. The gears 15A-15E are spur gears or helical gears.

The first transmission mechanism 15 includes an electromagnetic clutch 14 that is configured to intermittently transmit a drive force to the sheet supply roller 12. The electromagnetic clutch 14 uses an electromagnetic force to intermittently transmit a drive force to the sheet supply roller 12. The electromagnetic clutch 14 of the embodiment is configured to, when energized, transmit a drive force to the sheet supply roller 12, and configured to, when de-energized, interrupt a drive force to the sheet supply roller 12.

The second transmission mechanism 16 includes an output gear 13. The output gear 13 is an example of an output member, and is used for outputting a drive force to an external device (another sheet supply apparatus in this embodiment). The module size and the number of teeth of the output gear 13 are the same as those of the output gear MG1.

The second transmission mechanism 16 is configured to transmit a drive force supplied from the image forming apparatus 1 via the output gear MG1 to the output gear 13. The second transmission mechanism 16 is a gear train having plural gears 16A, 16B as with the first transmission mechanism 15.

A clutch mechanism 17 is disposed downstream from the output gear MG1 and upstream from the first transmission mechanism 15 and the second transmission mechanism 16. The clutch mechanism 17 is configured to intermittently transmit a drive force supplied from the image forming apparatus 1 to the first transmission mechanism 15 and the second transmission mechanism 16. In other words, the clutch mechanism 17 is configured to intermittently transmit the drive force to at least the second transmission mechanism 16.

The configuration of the clutch mechanism 17 will be described.

Figure 3:
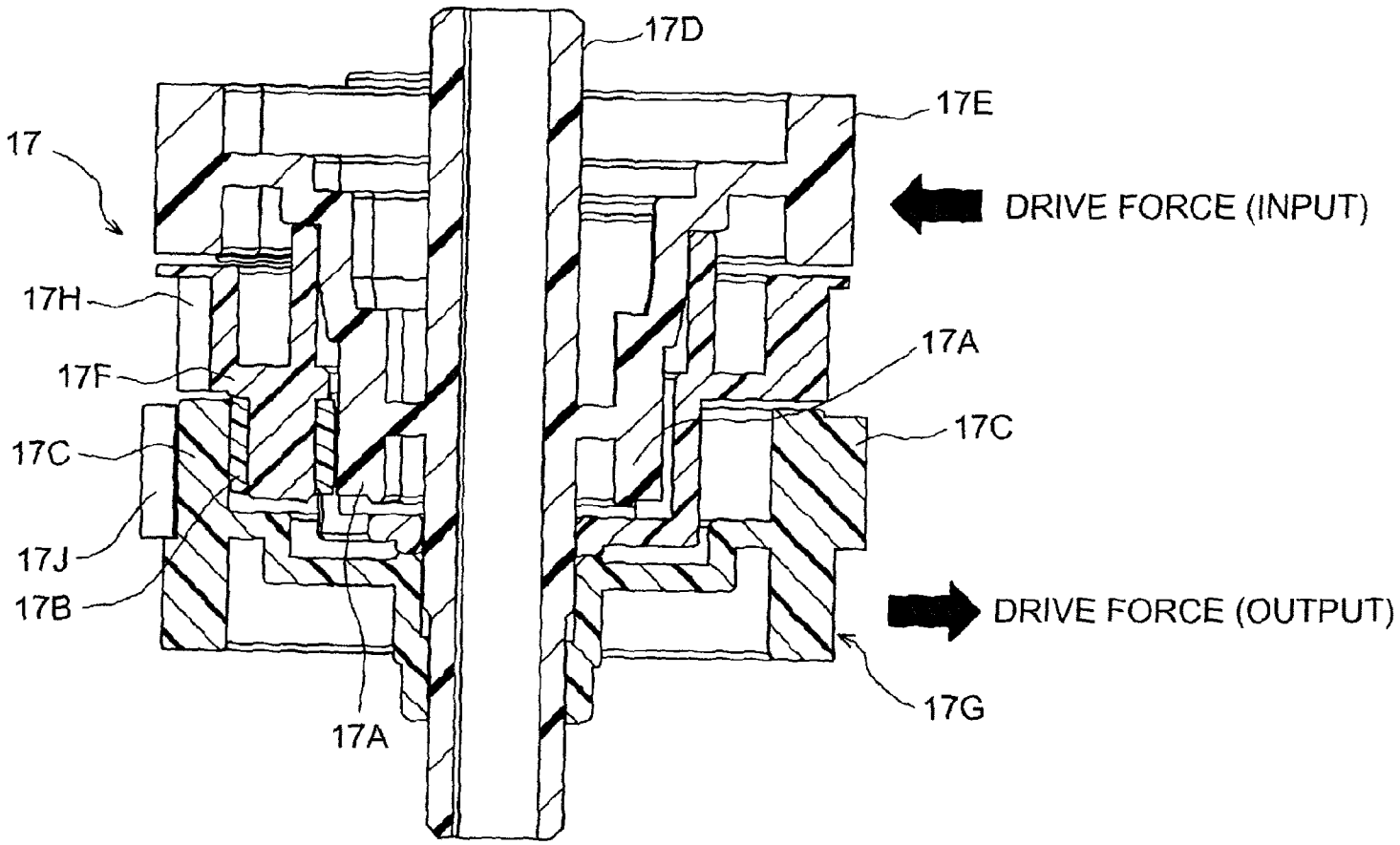
FIG. 3 schematically illustrates a clutch mechanism related to the first transmission mechanism and the second transmission mechanism.

As illustrated in FIG. 3, the clutch mechanism 17 uses a planetary gear train including a sun gear 17A, a planetary gear 17B, an internal gear 17C, an input gear 17E, a carrier 17F, and an output gear 17G. The sun gear 17A rotates about a shaft 17D together with the input gear 17E.

The input gear 17E receives a drive force supplied from the image forming apparatus 1 via the output gear MG1, and transmission gears TG1, TG2 (FIG. 2). The planetary gear 17B is in mesh with the sun gear 17A and the internal gear 17C at all times, and is held by the carrier 17F such that the planetary gear 17B rotates about its own axis and rotates around the sun gear 17A.

Rotation of the planetary gear 17B about its axis may be referred to just as rotation, and rotation of the planetary gear 17B around the sun gear 17A may be referred to as revolution. In this embodiment, the clutch mechanism 17 includes plural, e.g., three, planetary gears 17B.

The internal gear 17C is a ring gear with inward-facing teeth that mesh with the planetary gears 17B. The internal gear 17C has a common axis with the sun gear 17A. Rotation of the internal gear 17C is transmitted to the output gear 17G. In this embodiment, the internal gear 17C and the output gear 17G are integrally formed with each other.

During rotation of the sun gear 17A, when the planetary gears 17B are capable of revolving around the sun gear 17A, that is, when the carrier 17F is capable of rotating, the planetary gears 17B revolve around the sun gear 17A while rotating about their own axes. Thus, when the internal gear 17C has a high rotational resistance and the planetary gears 17B are capable of revolving around the sun gear 17A, the internal gear 17C does not rotate and transmission of a drive force is interrupted.

During rotation of the sun gear 17A, when the revolving movement of the planetary gears 17B around the sun gear 17A is restricted, that is, when the rotation of the carrier 17F is restricted, the planetary gears 17B rotate about their own axes and do not revolve around the sun gear 17A. Thus, when the revolving movement of the planetary gears 17B around the sun gear 17A is restricted, rotation of the sun gear 17A is transmitted to the internal gear 17C.

Figure 4:
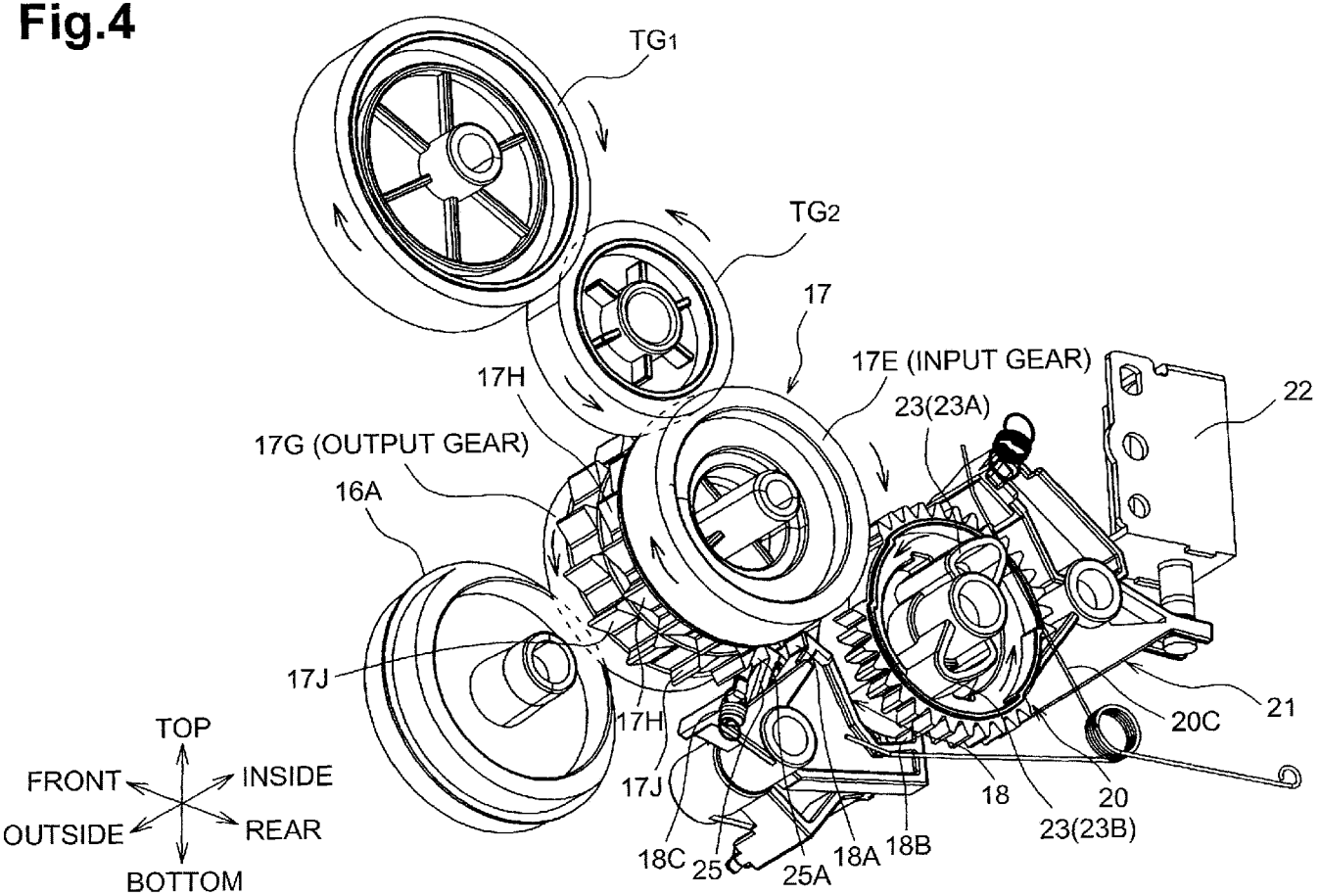
FIG. 4 is a perspective view of the clutch mechanism.

Rotation of the carrier 17F is controlled by a first latch member 18 illustrated in FIG. 4. In other words, the carrier 17F includes at least one first engagement portion 17H, which is engageable with a first engaging portion 18A provided at an end of the first latch member 18.

In the embodiment, the carrier 17F includes plural first engagement portion 17H. The first engagement portions 17H are evenly spaced apart from each other about the rotation axis of the carrier 17F. The first latch member 18 is pivotable between a restriction position and an allowance position.

Figure 5:
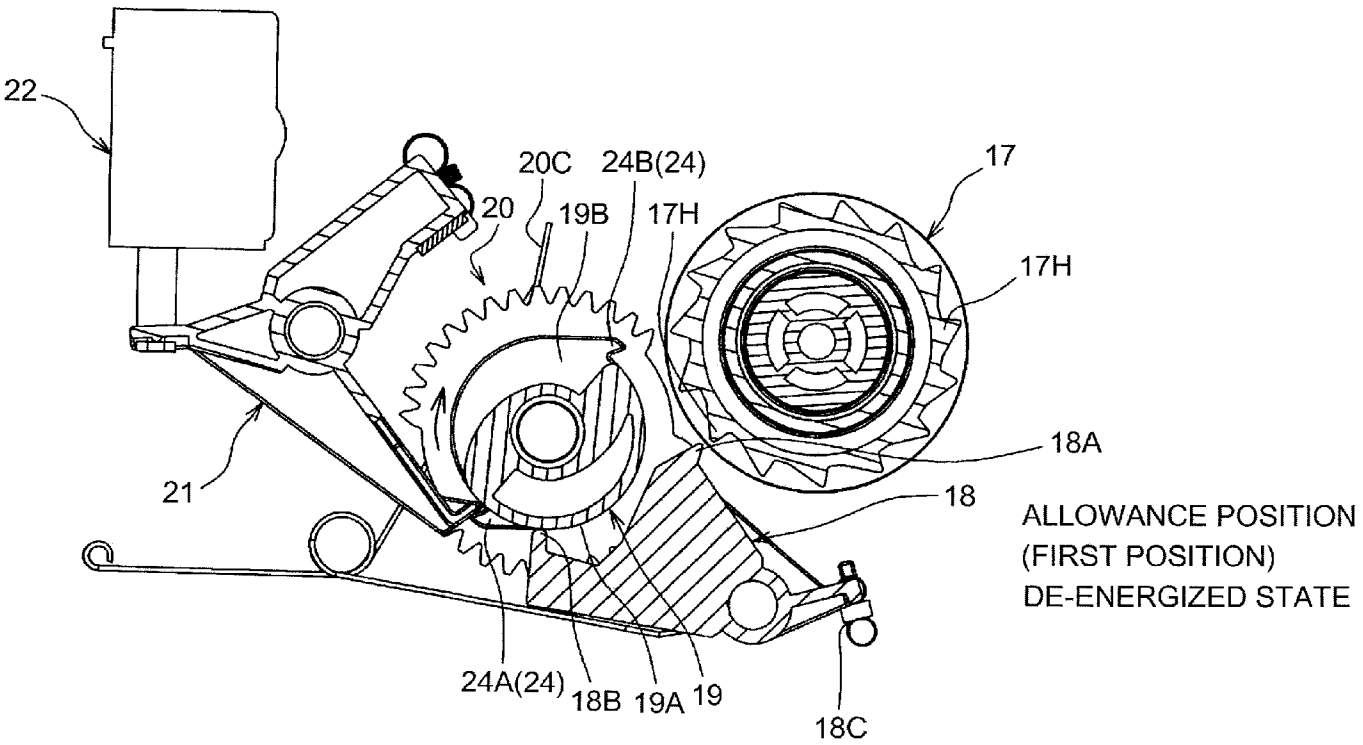
FIG. 5 illustrates the clutch mechanism and a sector gear.
Figure 7:
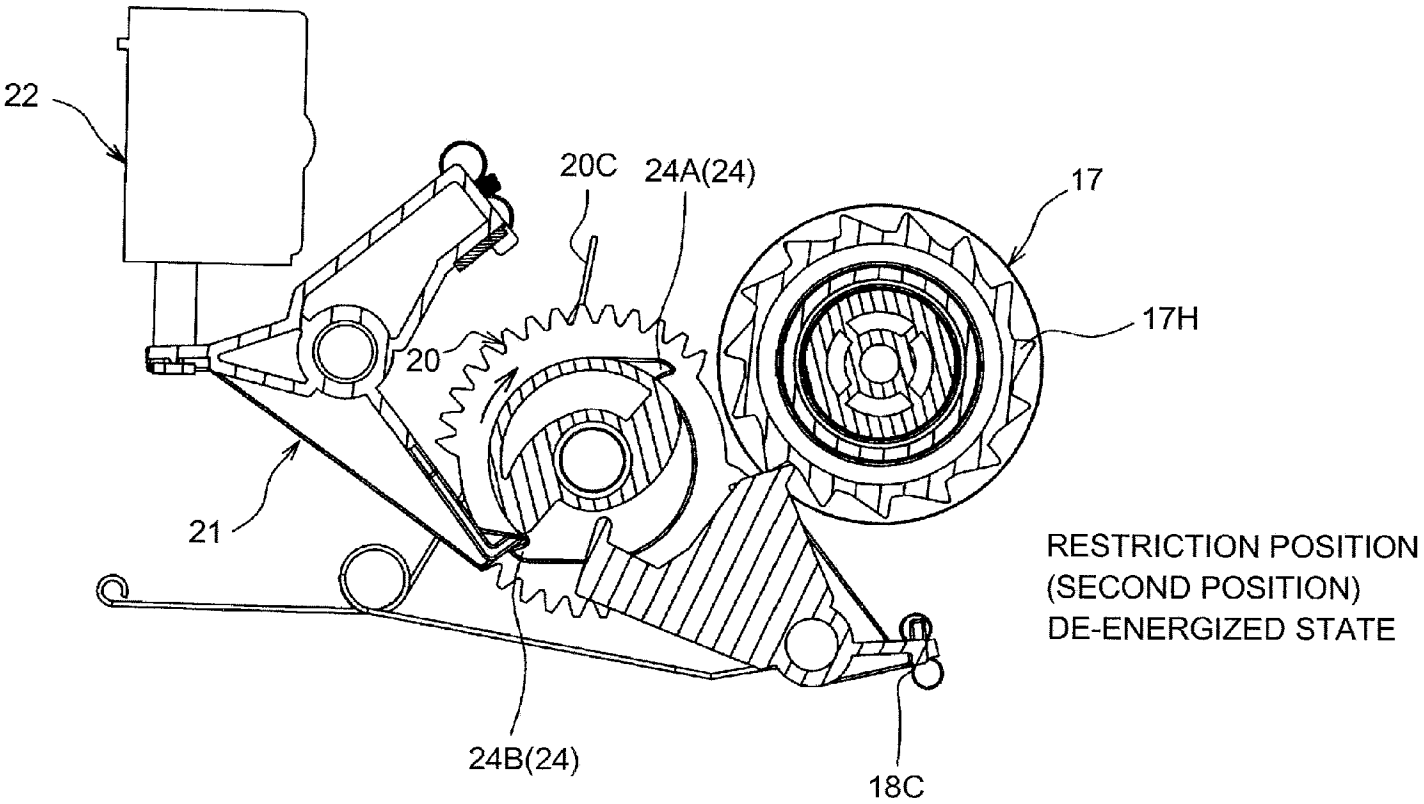
FIG. 7 illustrates the clutch mechanism and the sector gear.

The restriction position is where, as illustrated in FIG. 7, the first engaging portion 18A engages at a first engagement portion 17H, and the first latch member 18 restricts the planetary gears 17B from revolving around the sun gear 17A. The allowance position is where, as illustrated in FIG. 5, the first engaging portion 18A disengages from the first engagement portion 17H, and the first latch member 18 allows the planetary gears 17B to revolve around the sun gear 17A.

Figure 6:
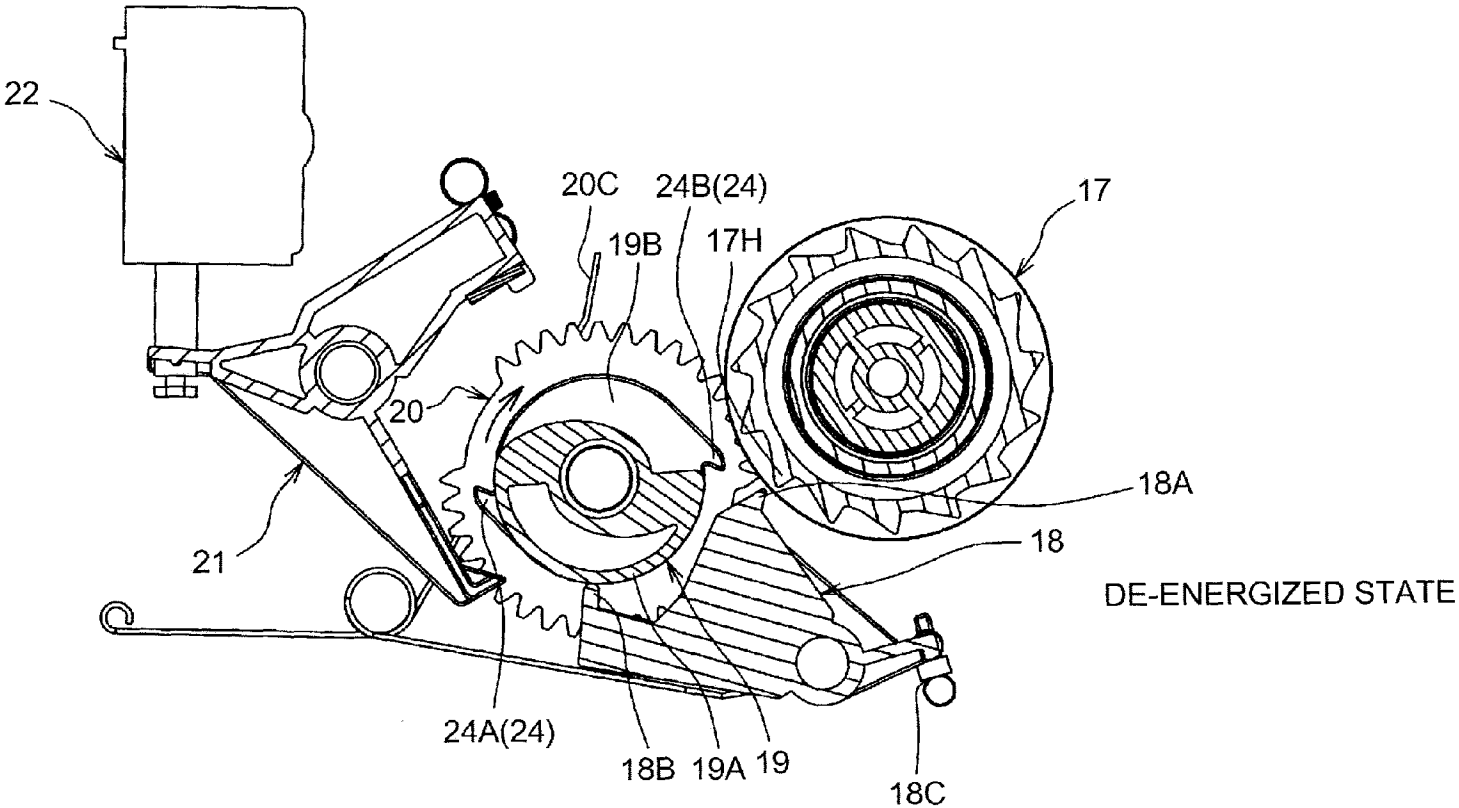
FIG. 6 illustrates the clutch mechanism and the sector gear.
Figure 9:
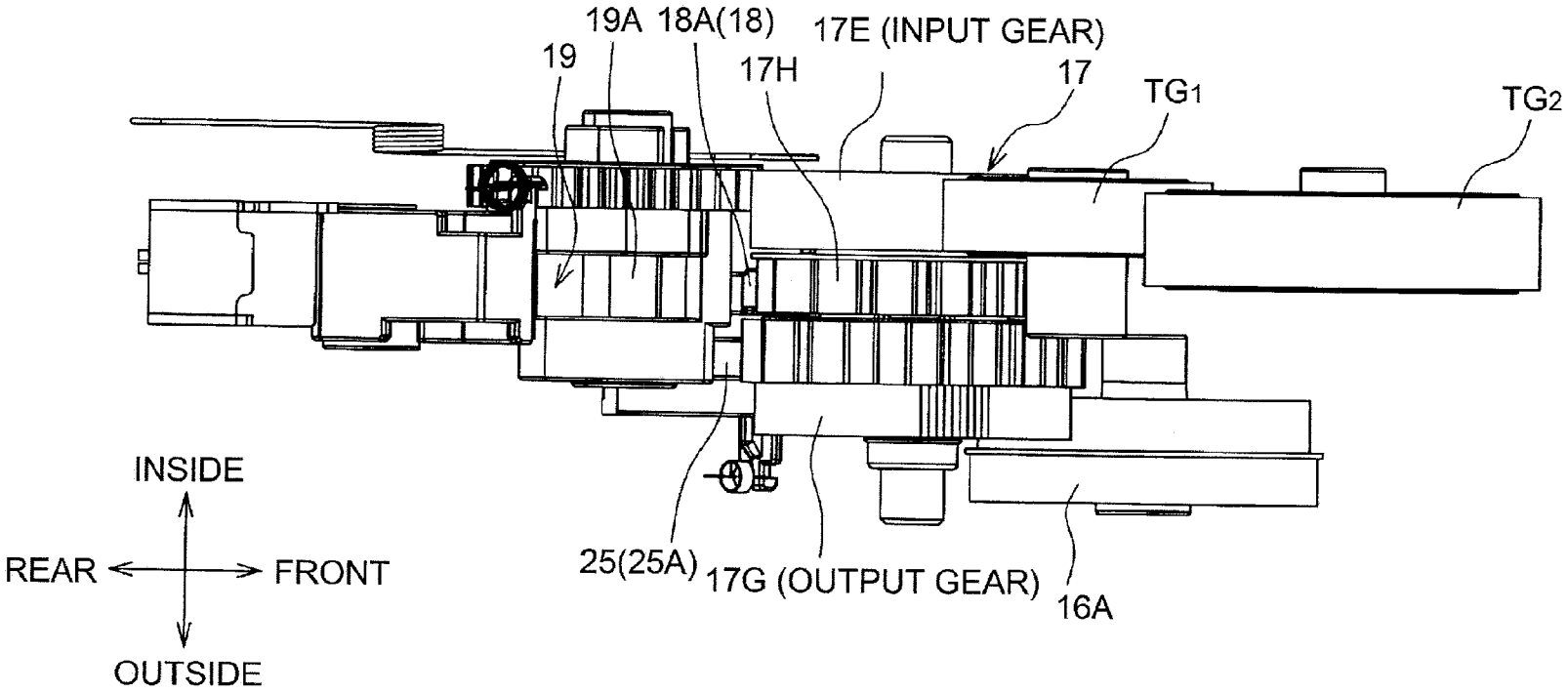
FIG. 9 is a plan view of the clutch mechanism and the sector gear.

Pivoting of the first latch member 18 is controlled by a change cam 19 (FIG. 9) that rotates in one direction. As illustrated in FIG. 6, the change cam 19 has a first contact surface 19A and includes a first non-contact portion 19B. The first contact surface 19A is formed on the outer circumferential surface of the change cam 19.

Figure 8:
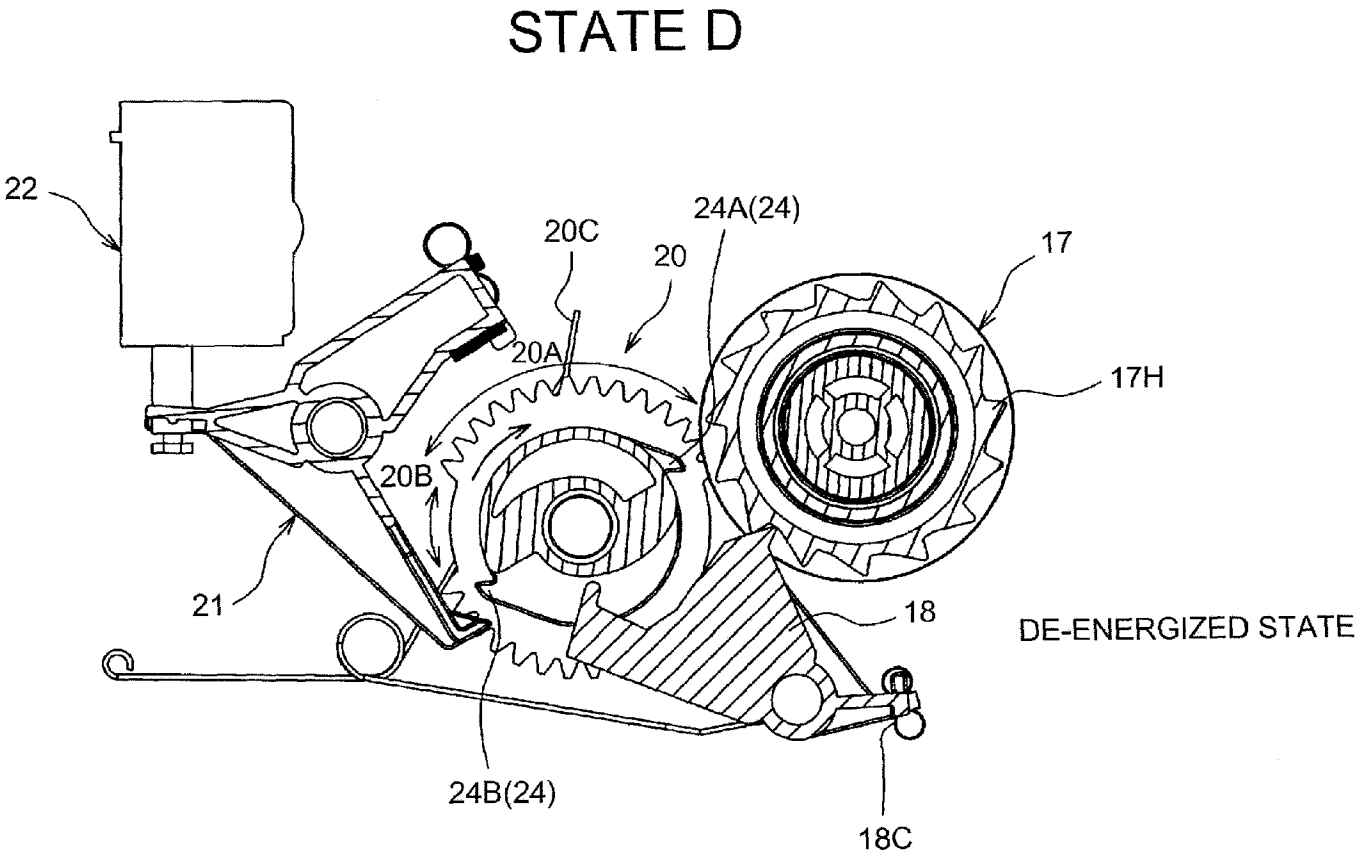
FIG. 8 illustrates the clutch mechanism and the sector gear.

The first contact surface 19A is a circumferential surface on which a sliding-contact portion 18B of the first latch member 18 slides. As illustrated in FIG. 8, the first non-contact portion 19B is a portion of the change cam 19 that does not contact the first latch member 18.

The portion of the change cam 19, which constitutes the first non-contact portion 19B, is recessed toward the center of rotation of the change cam 19 further than the first contact surface 19A. A first spring 18C applies an elastic force to the first latch member 18 to move the sliding-contact portion 18B toward the center of rotation of the change cam 19.

Thus, when the sliding-contact portion 18B is located at the first non-contact portion 19B, the sliding-contact portion 18B does not contact the change cam 19, and the first latch member 18 is located at the restriction position (FIG. 7). When the sliding-contact portion 18B is located at the first contact surface 19A, the first latch member 18 is located at the allowance position (FIG. 5).

In short, while the change cam 19 rotates in one direction, the change cam 19 alternately changes between a first position where the first latch member 18 is in the allowance position and a second position where the first latch member 18 is in the restriction position.

In this embodiment, substantially a half of the outer circumferential surface of the change cam 19 functions as the first contact surface 19A, and the remaining of the outer circumferential surface of the change cam 19 functions as the first non-contact portion 19B. Thus, the change cam 19 alternately changes into the first position and the second position every 180-degree rotation.

The sector gear 20 rotates the change cam 19 in one direction to alternate the first position and the second position in succession. In the embodiment, the sector gear 20 and the change cam 19 are arranged in a common axial direction and are combined into one body. Thus, the sector gear 20 and the change cam 19 rotate together such that their rotation angles agree with each other.

The sector gear 20 includes a portion with gear teeth (hereinafter referred to as a teeth portion 20A), and a portion having no teeth formed thereon (hereinafter referred to as a toothless portion 20B). The teeth portion 20A is capable of meshing with the input gear 17E.

Figure 10:
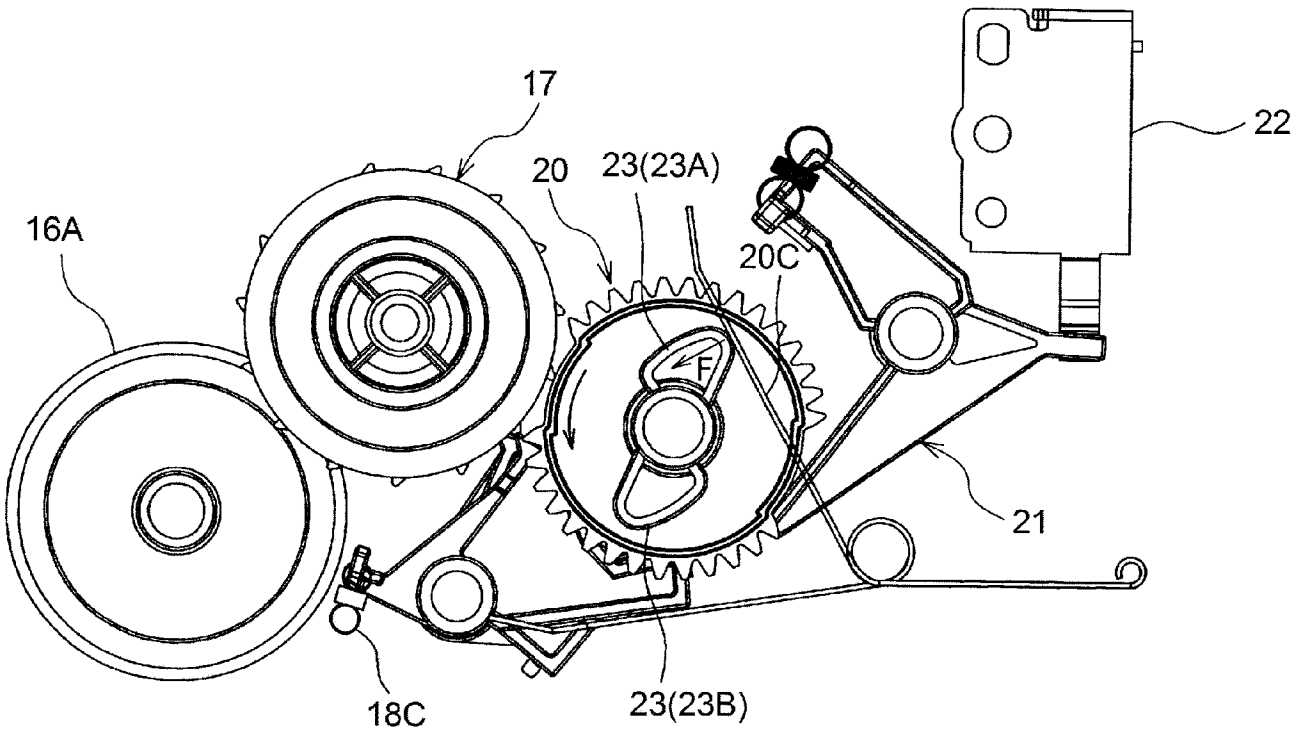
FIG. 10 illustrates the clutch mechanism and the sector gear.

In other words, the input gear 17E functions as a supply gear that, when the input gear 17E meshes with the teeth portion 20A of the sector gear 20, supplies a drive force from the image forming apparatus 1 to the sector gear 20. As illustrated in FIG. 10, a second spring 20C applies an elastic force to the sector gear 20 or the change cam 19 via a conversion cam 23.

The conversion cam 23 converts an elastic force of the second spring 20C to a force for rotating the sector gear 20 (hereinafter referred to as a motive power) by slidingly contacting the second spring 20C. The motive power is a force to, when the change cam 19 is in the first or second position, rotate the sector gear 20 until at least the teeth portion 20A meshes with the input gear 17E.

Figure 11:
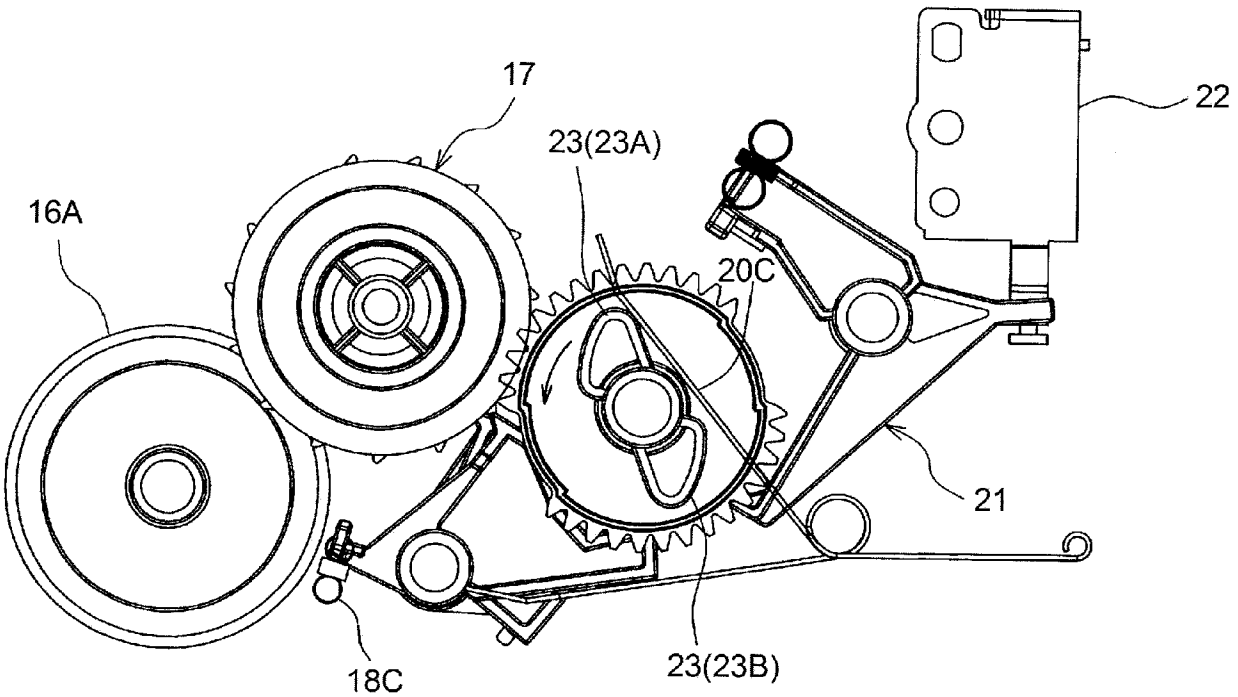
FIG. 11 illustrates the clutch mechanism and the sector gear.
Figure 12:
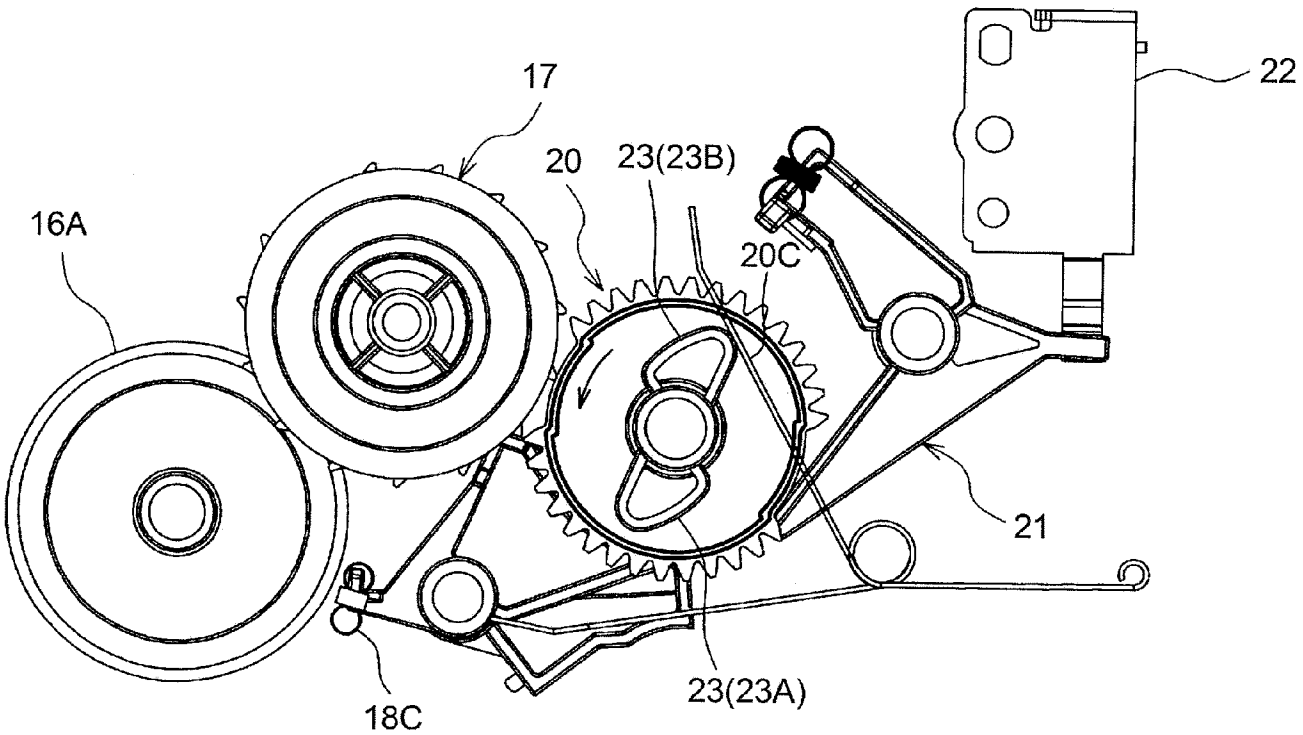
FIG. 12 illustrates the clutch mechanism and the sector gear.
Figure 13:
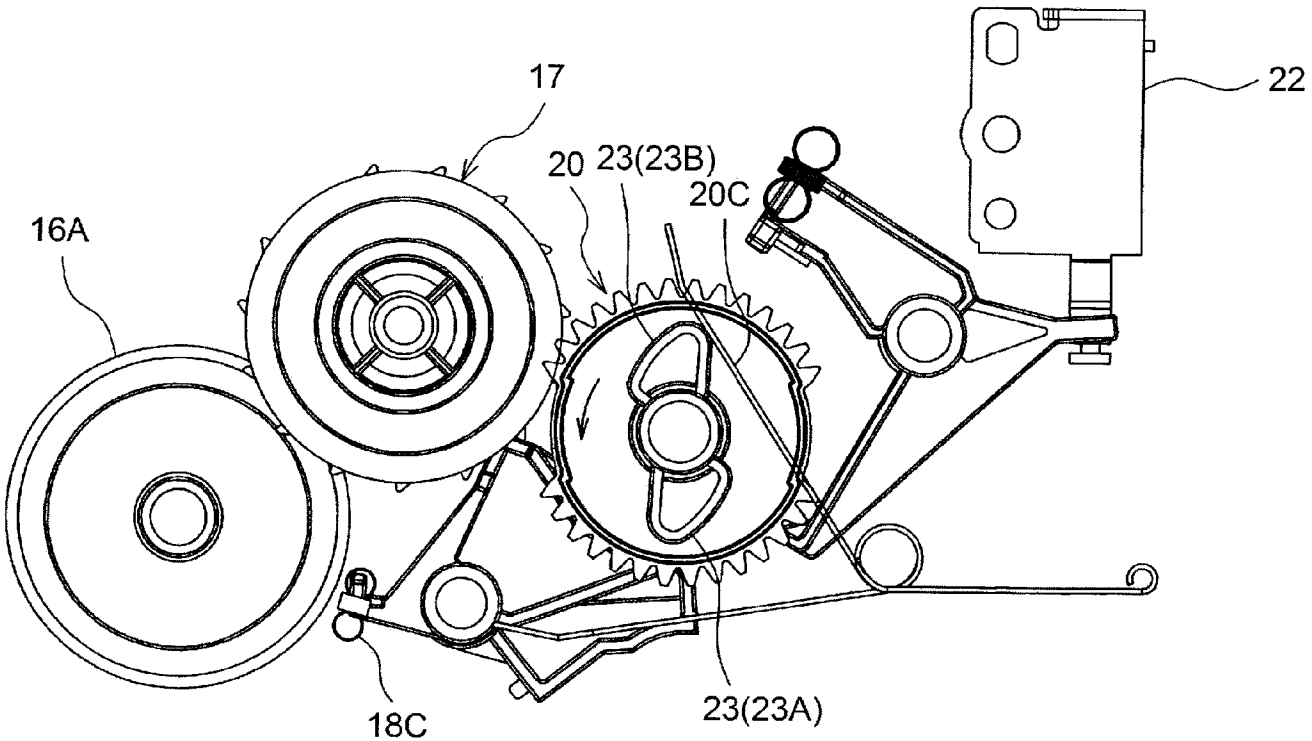
FIG. 13 illustrates the clutch mechanism and the sector gear.

Thus, when the teeth portion 20A and the input gear 17E mesh with each other, the second spring 20C does not contact a vertex portion of the conversion cam 23 (FIGS. 11 and 13). When the toothless portion 20B and the input gear 17E face each other, or when the teeth portion 20A and the input gear 17E do not mesh with each other, the second spring 20C contacts the vertex portion of the conversion cam 23 (FIGS. 10 and 12).

In the embodiment, the sector gear 20 and the change cam 19 are combined into one body. Thus, the conversion cam 23 may be disposed on one of the sector gear 20 and the change cam 19. In the embodiment, the conversion cam 23, the sector gear 20, and the change cam 19 are integrally formed of a resin.

In the embodiment, the conversion cam 23 includes a first change cam portion 23A and a second change cam portion 23B. As the change cam 19 alternately changes into the first position and the second position every 180-degree rotation, the first and second change cam portions 23A, 23B are disposed 180 degrees apart from each other.

The first and second change cam portions 23A, 23B each have a vertex portion. The vertex portion of the conversion cam 23 is referred to as the vertex portion of the first change cam portion 23A or the second change cam portion 23B. The first and second change cam portions 23A, 23B are collectively referred to as the conversion cam 23.

An engaging member 21 illustrated in FIG. 5 is configured to, when the second spring 20C contacts the vertex portion of the conversion cam 23, restrict the rotation of the sector gear 20. In other words, the sector gear 20 or the change cam 19 is provided with a first engagement portion 24A and a second engagement portion 24B. Hereinafter, the first engagement portion 24A and the second engagement portion 24B are collectively referred to as an engagement portion 24.

The engaging member 21 is engageable with an engagement portion 24 and is configured to move between an engagement position and a disengagement position. The engagement position is where the engaging member 21 engages the engagement portion 24 and restricts the rotation of the sector gear 20 (FIGS. 5 and 7).

The disengagement position is where the engaging member 21 disengages from the engagement portion 24 and allows the sector gear 20 to rotate (FIGS. 6 and 8). When the change cam 19 is in the first position, the first engagement portion 24A engages the engaging member 21 and restricts the rotation of the sector gear 20 (FIG. 5).

The second engagement portion 24B is spaced apart from the first engagement portion 24A in the rotation direction. When the change cam 19 is in the second position, the second engagement portion 24B engages the engaging member 21 and restricts the rotation of the sector gear 20 (FIG. 7).

The engaging member 21 and an electromagnetic solenoid 22 are coupled to each other. The electromagnetic solenoid 22 is an actuator for moving the engaging member 21. When energized, the electromagnetic solenoid 22 allows the engaging member 21 to move to the disengagement position. When de-energized, the electromagnetic solenoid 22 allows the engaging member 21 to move to the engagement position.

The timing of the energization or de-energization of the electromagnetic solenoid 22 is controlled by a controller 30 disposed in the image forming apparatus 1. The controller 30 is constituted by a computer including a central processing unit (CPU), a non-volatile memory such as read-only memory (ROM), and random access memory (RAM).

The controller 30 is configured to control the timing of the energization or de-energization of the electromagnetic solenoid 22 based on programs previously stored in non-volatile memory such as ROM. Specifically, the controller 30 is configured to supply power to the electromagnetic solenoid 22 when intermittently transmitting a drive force from the image forming apparatus 1, and cut power to the electromagnetic solenoid 22 when the teeth portion 20A meshes with the input gear 17E after power is supplied to the electromagnetic solenoid 22.

A second latch member 25 illustrated in FIG. 4 is an example of an output restricting member. The second latch member 25 restricts the rotation of the output gear 17G when the first latch member 18 is in the allowance position. The second latch member 25 allows the output gear 17G to rotate when the first latch member 18 is in the restriction position.

In other words, as illustrated in FIG. 3, the internal gear 17C or the output gear 17G includes plural second engagement portions 17J, which are engageable with a second engaging portion 25A (FIG. 4) provided at a tip of the second latch member 25. The second engagement portions 17J are evenly spaced apart from each other about the rotation axis of the internal gear 17C or the output gear 17G.

The second latch member 25 is movable between an engagement position where the second engaging portion 25A engages a second engagement portion 17J and a disengagement position where the second engaging portion 25A disengages from a second engagement portion 17J.

The second latch member 25 is mechanically coupled to the first latch member 18 and thus moves in association with the first latch member 18. In other words, when the first latch member 18 is in the allowance position, the second latch member 25 is in the engagement position. When the first latch member 18 is in the restriction position, the second latch member 25 is in the disengagement position.

Thus, when the first latch member 18 is in the allowance position, the rotation of the output gear 17G of the clutch mechanism 17 is restricted. When the first latch member 18 is in the restriction position, the output gear 17G is allowed to rotate.

The operation of the sector gear 20 will be described.

While the second spring 20C is in contact with the vertex portion of the conversion cam 23, the sector gear 20 receives a motive power or a rotational force by which the sector gear 20 rotates such that the teeth portion 20A of the sector gear 20 meshes with the input gear 17E.

Thus, while the second spring 20C is in contact with the vertex portion of the conversion cam 23, when the electromagnetic solenoid 22 is energized, the engaging member 21 disengages from an engagement portion 24, and the sector gear 20 receives a motive power, that is, an elastic force of the second spring 20C, and rotates until the teeth portion 20A and the input gear 17E mesh with each other.

When the teeth portion 20A and the input gear 17E mesh with each other, the energization of the electromagnetic solenoid 22 is interrupted. Then, the second spring 20C disengages from the vertex portion of the conversion cam 23 (FIGS. 11 and 13), and the sector gear 20 rotates by receiving a rotational force via the teeth portion 20A from the input gear 17E (FIGS. 6 and 8).

Then, when the toothless portion 20B reaches the input gear 17E, the engaging member 21 engages the first engagement portion 24A or the second engagement portion 24B (FIGS. 5 and 7), and the second spring 20C contacts the vertex portion of the conversion cam 23 (FIGS. 10 and 12).

Thus, the sector gear 20 alternately changes between a state illustrated in FIG. 5 where the engaging member 21 engages the first engagement portion 24A and a state illustrated in FIG. 7 where the engaging member 21 engages the second engagement portion 24B every energization of the electromagnetic solenoid 22. The period of the energization is from a time when the energization of the electromagnetic solenoid 22 starts to a time when the teeth portion 20A mesh with the input gear 17E.

When the clutch mechanism 17 is in a state where transmission of a drive force is interrupted (hereinafter referred to as an interruption state), the first engagement portion 24A engages the engaging member 21, the first latch member 18 is located at the allowance position (FIG. 5), and the second spring 20C contacts the vertex portion of the first conversion cam 23A (FIG. 10).

When the clutch mechanism 17 is in a state where a drive force is transmissible (hereinafter referred to as a transmission state), the second engagement portion 24B engages the engaging member 21, the first latch member 18 is located at the restriction position (FIG. 7), the second spring 20C contacts the vertex portion of the second conversion cam 23B (FIG. 12).

The clutch mechanism 17, the sector gear 20, the change cam 19 and their neighboring members are turned into state A (FIGS. 5 and 10), state B (FIGS. 6 and 11), state C (FIGS. 7 and 12), and state D (FIGS. 8 and 13) in this order every time the electromagnetic solenoid 22 is energized.

For example, when the electromagnetic solenoid 22 is energized under the interruption state (FIG. 5), a motive power is generated and a set of the sector gear 20 and the change cam 19 starts to rotate. Then, the teeth portion 20A of the sector gear 20 and the input gear 17E mesh with each other, and a rotational force supplied from the input gear 17E allows the set of the sector gear 20, the change cam 19 and the conversion cam 23to rotates (FIGS. 6 and 11).

When the second spring 20C contacts the second conversion cam 23B and a motive power is generated at the conversion cam 23, the engaging member 21 engages the second engagement portion 24B, the teeth portion 20A disengages from the input gear 17E, and the rotational force supplied form the input gear 17E disappears.

At this time, the set of the sector gear 20, the change cam 19 and the conversion cam 23 stops rotating (FIGS. 7 and 12), and the clutch mechanism 17 enters the transmission state.

For example, when the electromagnetic solenoid 22 is energized under the transmission state (FIG. 7), a motive power is generated and the set of the sector gear 20 the change cam 19, and the conversion cam 23 starts to rotate. Then, the teeth portion 20A of the sector gear 20 meshes with the input gear 17E, and a rotational force supplied from the input gear 17E allows the set of the sector gear 20, the change cam 19 and the conversion cam 23 to rotate (FIGS. 8 and 13).

When the second spring 20C contacts the first conversion cam 23A and a motive power is generated at the conversion cam 23, the engaging member 21 engages the first engagement portion 24A, the teeth portion 20A disengages from the input gear 17E, and a rotational force supplied from the input gear 17E disappears.

At this time, the set of the sector gear 20, the change cam 19 and the conversion cam 23 stops rotating (FIGS. 5 and 10), and the clutch mechanism 17 enters the interruption state.

Energization of the electromagnetic solenoid 22 will be controlled as follows.

Figure 14:
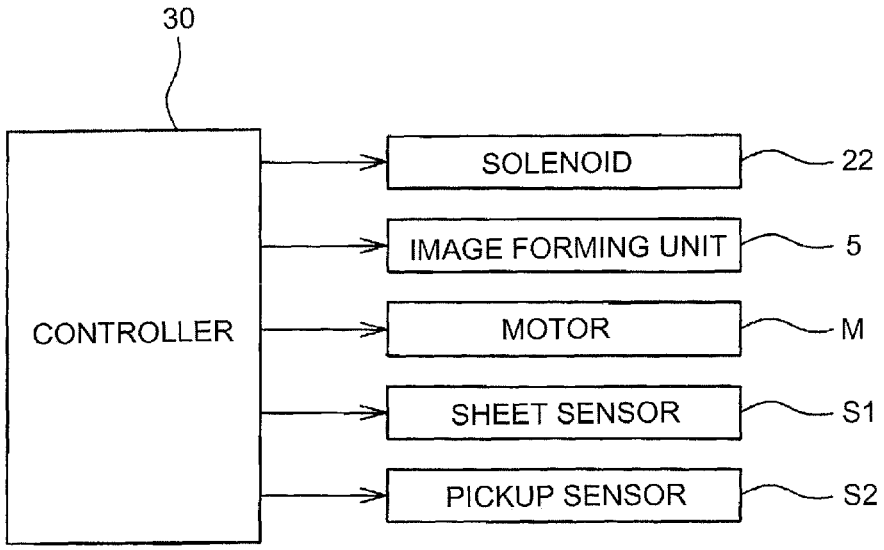
FIG. 14 is a block diagram of the image forming system.

The controller 30 accepts inputs of detection signals from a sheet sensor S1 and a pick-up sensor S2 illustrated in FIG. 14. The sheet sensor S1 is a sensor for detecting the presence or absence of a sheet on the sheet supply tray 11. The pick-up sensor S2 is a sensor disposed downstream from the sheet supply roller 12 in the sheet feeding direction for detecting whether a sheet has passed.

By executing programs stored in the non-volatile memory at the CPU, the controller 30 determines whether, when the electromagnetic solenoid 22 is de-energized, the clutch mechanism 17 is in the transmission state or the interruption state (hereinafter this process is referred to as a transmission state determination).

Namely, the controller 30 or CPU determines that, in a case where a passage of a sheet is not detected and presence of a sheet on the sheet supply tray 11 is detected after a drive force is transmitted to the sheet supply roller 12, the clutch mechanism 17 is in the interruption state.

The controller 30 determines that, in a case where a passage of a sheet is not detected and absence of a sheet on the sheet supply tray 11 is detected after a drive force is transmitted to the sheet supply roller 12, the clutch mechanism 17 is in the transmission state.

The controller 30 executes the transmission state determination at least during a first-ever image formation after a power switch (not shown) of the image forming apparatus 1 is turned on. When executing the transmission state determination, the controller 30 recognizes the current transmission state of the clutch mechanism 17 by writing a flag showing the transmission state or the interruption state in the RAM. When the controller 30 determines that the clutch mechanism 17 is in the interruption state during the image formation, the controller 30 supplies power to the electromagnetic solenoid 22 again to continue image formation.

Features of the image forming system, especially, the sheet supply apparatus, will be described below.

In this embodiment, when an energized state and a de-energized state of the electromagnetic solenoid 22 are repeated, the state of the clutch mechanism 17 changes in the order of state A (FIGS. 5 and 10), state B (FIGS. 6 and 11), state C (FIGS. 7 and 12), and state D (FIGS. 8 and 13) every time the electromagnetic solenoid 22 is energized. That is, the clutch mechanism 17 is switched, like a momentary switch, between the transmission state and the interruption state.

In other words, while the electromagnetic solenoid 22 is in the de-energized state after it is energized, the clutch mechanism 17 remains in the interruption state until the electromagnetic solenoid 22 is energized next time. Thus, this structure obviates the need to continue to supply power to the electromagnetic solenoid 22 and thus maintains the electromagnetic solenoid 22 in the interruption state, which leads to reduction in power consumption and noise at the second transmission mechanism 16.

In the embodiment, the second latch member 25 is configured to restrict the rotation of the output gear 17G when the clutch mechanism 17 is in the interruption state.

This structure reliably reduces the possibility of transmitting a drive force to the output gear 17G when the clutch mechanism 17 is in the interruption state, even if the rotation resistance of the output gear 17G is low.

The first transmission mechanism 15 of the embodiment includes the electromagnetic clutch 14, which reduces the possibility of unintentional rotation of the sheet supply roller 12.

A second embodiment will be described.

It is noted that, in the second embodiment, elements similar to or identical with those shown and described in the above first embodiment are designated by similar numerals, and thus the description thereof can be omitted for the sake of brevity.

Figure 15:
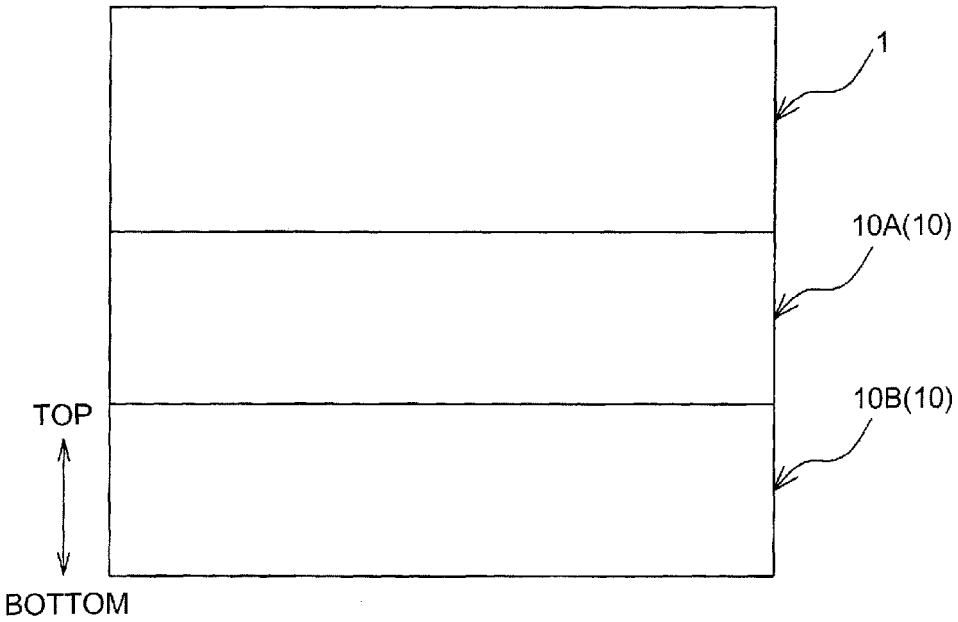
FIG. 15 schematically illustrates an image forming system according to a second illustrative embodiment.

As illustrated in FIG. 15, the second embodiment shows an image forming system made up of the image forming apparatus 1 of the first embodiment, a first sheet supply apparatus 10A, and a second sheet supply apparatus 10B, which are identical in structure to the sheet supply apparatus 10 of the first embodiment.

The first sheet supply apparatus 10A is configured to obtain a drive force from the image forming apparatus 1 and supply a sheet to the image forming apparatus 1. The second sheet supply apparatus 10B is detachably attached to the first sheet supply apparatus 10A, and is configured to obtain a drive force from the output gear 13 of the first sheet supply apparatus 10A and supply a sheet to the image forming apparatus 1.

In controlling the clutch mechanism 17 of the second sheet supply apparatus 10B and changing at least changing from the interruption state to the transmission state, the controller 30 executes the following energization control. Programs for the energization control are stored in the non-volatile memory.

The controller 30 or the CPU starts to supply power to the electromagnetic solenoid 22 of the first sheet supply apparatus 10A, and then starts to supply power to the electromagnetic solenoid 22 of the second sheet supply apparatus 10B. Then, the controller 30 stops supplying power to the electromagnetic solenoid 22 of the second sheet supply apparatus 10B, and then stops supplying power to the electromagnetic solenoid 22 of the first sheet supply apparatus 10A.

This reduces the drive load to be generated at the clutch mechanism 17 of the first sheet supply apparatus 10A, and thus reduces noise made during operation of the clutch mechanism 17. Noise made during operation of the clutch mechanism 17 may include collision noise made when the first latch member 18 engages the clutch mechanism 17.

Parenthetically, if the electromagnetic solenoid 22 of the second sheet supply apparatus 10B is energized and then the electromagnetic solenoid 22 of the first sheet supply apparatus 10A is energized, the clutch mechanism 17 of the first sheet supply apparatus 10A is subjected to a drive load of the first sheet supply apparatus 10A and the second sheet supply apparatus 10B, which leads to increased noise during operation.

The above embodiments show but are not limited to that the clutch mechanism 17 is located upstream of the first transmission mechanism 15 and the second transmission mechanism 16. For example, the clutch mechanism 17 may be located in the second transmission mechanism 16.

The planetary gear train of the disclosure includes a differential. Parenthetically, the planetary gear of the planetary gar train corresponds to a pinion gear of the differential.

The above embodiments show but are not limited to the second latch member 25. The second latch member 25 may be omitted.

What is claimed is:

1. A sheet supply apparatus detachably attached to an image forming apparatus configured to form an image on a sheet, the sheet supply apparatus being configured to receive a drive force from the image forming apparatus to supply a sheet to the image forming apparatus, the sheet supply apparatus comprising:

a sheet supply tray configured to support a sheet;

a sheet supply roller configured to supply the sheet supported on the sheet supply tray toward the image forming apparatus;

a first transmission mechanism configured to transmit a drive force from the image forming apparatus to the sheet supply roller;

a second transmission mechanism including an output member, the second transmission mechanism being configured to transmit a drive force supplied from the image forming apparatus to the output member;

a clutch mechanism configured to intermittently transmit a drive force from the image forming apparatus to the second transmission mechanism, the clutch mechanism including a sun gear, a planetary gear, and an internal gear;

a latch member pivotable between a restriction position where the latch member restricts the planetary gear from revolving around the sun gear and an allowance position where the latch member allows the planetary gear to revolve around the sun gear, the latch member including a sliding-contact portion;

a change cam including a contact surface on which the sliding-contact portion of the latch member slides, the change cam being configured to rotate in one direction to change between a first position where the latch member is in the allowance position and a second position where the latch member is in the restriction position;

a sector gear having a tooth portion and a toothless portion, the sector gear being configured to rotate together with the change cam;

a rotational force applying member configured to apply a rotational force to the sector gear such that the sector gear rotates in the one direction;

an engaging member configured to engage one of the sector gear and the change cam and move between a disengagement position where the sector gear rotates and an engagement position where the sector gear is restricted from rotating;

a first engagement portion disposed at the one of the sector gear and the change cam and configured to, when the change cam is located at the first position, engage the engaging member to restrict the sector gear from rotating;

a second engagement portion disposed at the one of the sector gear and the change cam and spaced apart from the first engagement portion in a rotation direction of the sector gear and the change cam, the second engagement portion being configured to, when the change cam is located at the second position, engage the engaging member to restrict the sector gear from rotating; and an electromagnetic solenoid coupled to the engaging member, the electromagnetic solenoid being configured to, when energized, move the engaging member to the disengagement position, and to, when de-energized, move the engaging member to the engagement position.

2. The sheet supply apparatus according to claim 1, further comprising an output restricting member coupled to the latch member, the output restricting member being configured to, when the latch member is at the allowance position, restrict the output gear of the clutch mechanism from rotating, and to, when the latch member is at the restriction position, allow the output gear of the clutch mechanism to rotate.

3. The sheet supply apparatus according to claim 1, wherein the first transmission mechanism includes an electromagnetic clutch configured to intermittently transmit a drive force supplied from the image forming apparatus to the sheet supply roller.

4. The sheet supply apparatus according to claim 1, further comprising:

a sheet sensor for detecting a presence or absence of a sheet on the sheet supply tray;

a pick-up sensor disposed downstream from the sheet supply roller in a sheet feeding direction for detecting whether the sheet has passed; and a controller configured to determine whether, when the electromagnetic solenoid is in a de-energized state, the clutch mechanism is in a transmission state where a drive force is transmissible or an interruption state where transmission of a drive force is interrupted, wherein the controller is configured to determine that:

in a case where, after the sheet supply roller receives a drive force, the pick-up sensor detects no passage of a sheet and the sheet sensor detects presence of a sheet on the sheet supply tray, the clutch mechanism is in the interruption state; and in a case where, after the sheet supply roller receives a drive force, the pick-up sensor detects no passage of a sheet and the sheet sensor detects absence of a sheet on the sheet supply tray, the clutch mechanism is in the transmission state.

5. The sheet supply apparatus according to claim 1, wherein the clutch mechanism further includes a supply gear having teeth configured to mesh with the teeth portion of the sector gear, the supply gear being configured to, when meshing with the teeth portion of the sector gear, supply a drive force from the image forming apparatus to the sector gear, and wherein the rotational force applying member includes a spring configured to cause the sector gear to rotate until the teeth portion of the sector gear meshes with the supply gear, wherein, when the electrostatic solenoid is de-energized, the teeth of the supply gear are located at the teeth portion of the sector gear.

6. An image forming system comprising:

an image forming apparatus configured to form an image on a sheet;

a first sheet supply apparatus comprising the sheet supply apparatus according to claim 1, the first sheet supply apparatus being detachably attached to the image forming apparatus and receive a drive force from the forming apparatus to supply a sheet to the image forming apparatus;

a second sheet supply apparatus comprising the sheet supply apparatus according to claim 1, the first sheet supply apparatus being detachably attached to the first sheet supply apparatus and receive a drive force from the output member of the first sheet supply apparatus to supply a sheet to the image forming apparatus; and a controller configured to energize the electromagnetic solenoid of the second sheet supply apparatus after energizing the electromagnetic solenoid of the first sheet supply apparatus.

7. The image forming system according to claim 6, wherein the controller is configured to de-energize the electromagnetic solenoid of the second sheet supply apparatus after de-energizing the electromagnetic solenoid of the first sheet supply apparatus.

* * * * *